United States Patent [19]

Taylor

[11] 4,380,456

[45] Apr. 19, 1983

[54] GASOLINE FUEL ADDITIVE COMPOSITION

[76] Inventor: William H. Taylor, 2311 Marca Pl., Carlesbad, Calif. 92008

[21] Appl. No.: 288,600

[22] Filed: Jul. 30, 1981

[51] Int. Cl.[3] ..... C10L 1/18; C10L 1/30

[52] U.S. Cl. ..... 44/68; 44/66; 44/79

[58] Field of Search ..... 44/66, 67, 68

[56] References Cited

U.S. PATENT DOCUMENTS

| | | | |
|---|---|---|---|
| 2,197,498 | 4/1940 | Buthmann | 44/9 |
| 2,681,922 | 6/1954 | Balthis | 260/414 |
| 2,891,089 | 6/1959 | Jolly | 260/468 |
| 3,003,859 | 10/1961 | Irish et al. | 44/68 |
| 3,056,666 | 10/1962 | Fischl et al. | 44/66 |
| 3,529,943 | 9/1970 | Patinkin | 44/63 |
| 3,594,138 | 7/1971 | Bodin | 44/70 |
| 3,594,138 | 7/1971 | Badin | 44/6 |
| 4,297,110 | 10/1981 | Feldman | 44/68 |

OTHER PUBLICATIONS

Kirk-Olhmer; Encyclopedia of Chemical Technology, vol. 15, pp. 726 and 724.

*Primary Examiner*—Jacqueline V. Howard
*Attorney, Agent, or Firm*—Nilsson, Robbins, Dalgarn, Berliner, Carson & Wurst

[57] ABSTRACT

A composition suitable for use as an additive to gasoline to increase the efficiency of use thereof comprising, in solution: about 10 to about 35 percent by volume of a zirconium salt of an organic acid; about 10 to about 35 percent by volume of a plasticizer boiling above 300° C. and comprising as a part of its structure an ester group or an aromatic group, or both; and from 0 to about six percent by volume of an organic acid capable of forming a salt with zirconium. A solvent for said zirconium salt and said plasticizer may be provided comprising a hydrocarbon or a halogenated aliphatic hydrocarbon, or a mixture thereof, as a major component of the solvent.

9 Claims, No Drawings

GASOLINE FUEL ADDITIVE COMPOSITION

FIELD OF THE INVENTION

The field of art to which the invention pertains includes the field of fuel additives, particularly gasoline fuel additives.

BACKGROUND AND SUMMARY OF THE INVENTION

This invention relates to a new additive composition for the more efficient utilization of gasoline and to new liquid fuel compositions.

Modern constraints on energy consumption have made it more important than ever to obtain the greatest degree of efficiency in combustion of petroleum-derived fuels. Over the decades, tremendous efforts have gone into the search for gasoline and other fuel additives to serve a variety of purposes to make the combustion of fuel not only more efficient but also cleaner with respect to air pollution requirements. These research efforts have led investigators down certain paths with a consequent characterization of certain types of additives as having a particular function. For example, certain organic acid salts of the various heavy metals have been characterized as stabilizers for gasoline and similar fuels; see for example, Guthmann U.S. Pat. No. 2,197,498. Such compounds have also been known to serve as smoke depressant additives for diesel fuel mixtures and the like; see Badin U.S. Pat. No. 3,594,138. Other heavier metal compounds of very specialized organic molecules have been used as anti-knock compounds, as in Patinkin U.S. Pat. No. 3,529,943, as polymeric surface active materials, as in Balthis U.S. Pat. No. 2,681,922, as chelates to improve the combustion characteristics of relatively non-volatile hydrocarbon fuels, as in Irish et al U.S. Pat. No. 3,003,859, and as sediment stabilizers as in Fischl et al U.S. Pat. No. 3,056,666. Heavy organic acids have been utilized to form ester compositions used for gasoline to inhibit ice formation, as in Jolly U.S. Pat. No. 2,891,089. The foregoing listing is simply exemplary of a wide effort to cure or ameliorate, by use of additives, a variety of adverse properties of gasoline or other fuels. Because of the extensiveness of the effort, virtually every fuel-soluble organic and inorganic compound has been tested in gasoline for one purpose or another.

In spite of these efforts, it appears that up to now, the art has not appreciated that a very specific combination of gasoline soluble components has the ability to provide an overall improvement in the combustion characteristics of fuel, particularly gasoline. In this regard, I have discovered that a particular composition provides improved combustion, increasing horsepower and fuel efficiency, reducing exhaust emissions of carbon monoxide and hydrocarbons, and reducing detonation attributable to less than optimum octane fuel, incomplete mixing of fuel and air, or uneven distribution of the fuel/air mixture.

In particular, I provide a composition suitable for use as an additive to gasoline to increase the efficiency of use thereof, comprising, in solution: about 10 to about 35 percent by volume of a zirconium salt of an organic acid; about 10 to about 35 percent by volume of a plasticizer boiling above 300° C. and comprising as a part of its structure an ester group or an aromatic group, or both; from 0 to about 6 percent by volume of an organic acid capable of forming a salt with zirconium; and a solvent for said zirconium salt and said plasticizer comprising a hydrocarbon or a halogenated aliphatic hydrocarbon, or a mixture thereof, as a major component of said solvent.

DETAILED DESCRIPTION

Of essential significance is the combination of a zirconium salt of an organic acid and a plasticizer having particular characteristics. With regard to the zirconium salt, in general terms the organic moiety can be any component that will serve to solubilize the zirconium ion in gasoline, including the alkanoic acids described in Badin U.S. Pat. No. 3,594,138, naphthenic acid, organic acids obtained from various soaps such as tall oil soap, and the like. A preferred salt, resulting in a demonstrably effective additive, is that obtained by combining zirconium with one or more branched-chain acids having 8–12 carbon atoms, exemplified by 2-ethylhexanoic acid. Such zirconium salts can be obtained commercially from Tenneco Chemicals, Piscataway, N.J., under the trade designation NUXTRA. This is a line of driers prepared from 8 to 12 carbon atom branched chain synthetic acids and is sold with a metal content of zirconium from 6 percent to 24 percent by weight.

The plasticizer is an organic material boiling above 300° C. whose structure includes ester groups, aromatic groups, or both. It can be any of a variety of materials, for example, a petroleum lubricant distillate from an asphaltic crude, boiling between 300° and 400° C., and containing between 30 and 40 percent aromatic molecules. Such a material is sold by the Exxon Corporation under the trademark CORAY 15. Alternatively, one could use a naturally occurring ester, comparable to sesame seed oil, of a major amount of fatty acid selected from oleic acid and linoleic acid, or both, and a minor amount of palmitic acid. Again, alternatively, one could use a dialkyl phthalate in which each alkyl group has at least 3 carbon atoms, and up to 12 carbon atoms, provided the boiling point is at least 300° C., exemplified by dioctyl(di-2-ethyl hexyl)phthalate.

Optionally, one can add a small amount, up to about 6 volume percent, preferably 4 volume percent of the acid component of the zirconium salt, or a similar acid, i.e., an acid capable of forming a salt with zirconium. This can serve to impart stability to the zirconium salt component of the formulation.

As solvent, one can add any hydrocarbon or any halogenated aliphatic hydrocarbon, or mixture, in which the zirconium salt and plasticizer is soluble. When using commercial sources for the zirconium salt, there may be provided a solvent component which can serve as the solubilizing solvent.

The compositions provided herein are particularly useful in improving the performance characteristics of gasoline fuels, and can be added to ordinary gasoline, regardless of other additives therein, to the extent of about 0.01 to about 0.1 percent by volume, preferably to about 0.02 to about 0.06 percent by volume.

The following examples will serve to further illustrate the invention:

EXAMPLE 1

An additive is prepared by mixing 74.98 parts by volume of a NUXTRA zirconium 6 percent drier, 24.99 percent by volume of dioctyl phthalate. The NUXTRA zirconium 6 percent comprises about 17 percent by weight of zirconium 2-ethylhexanoate and 78 percent by weight petroleum distillate, the combination containing about 6.0 percent by weight zirconium metal ion. The distillate has a boiling point of about 157°–193° C. and negligible solubility in water.

The combination is added at a concentration of 0.035 percent by volume to gasoline to enhance the combustion characteristics of the gasoline.

The gasoline was tested against the same gasoline without the additive using as a test vehicle a 1979 Ford LTD, having, at the start of test 32,218 miles. Tests were conducted on a chassis dynamometer under steady state conditions at 43 miles per hour on the dynamometer. The vehicle had a manifold vacuum of 19.2 in. Hg, constant throughout testing. The results obtained are listed in Table 1.

TABLE 1

| | | | | Fuel Consumption | |
|---|---|---|---|---|---|
| Additive | Speed (mph) | Dyno Beam(lbs.) | Calculated Horsepower | Avg. Time 150 ml | Calculated mph |
| 0 | 43 | 50.25 | 6.05 | 85.08 | 19.3 |
| .035 vol % | 43 | 62.30 | 7.50 | 92.10 | 20.9 |

As shown in Table 1, the use of the additive increased horsepower by about 24 percent and decreased fuel consumption by about 8 percent.

EXAMPLE 2

A gasoline additive is prepared by mixing 24.2 volume percent of NUXTRA zirconium 18 percent drier with 14.8 volume percent of 2-ethylhexanoic acid. The NUXTRA zirconium 18 percent drier comprises 51 weight percent zirconium 2-ethylhexanoate and 35 weight percent petroleum distillate having a boiling point of about 157°–193° C. The material is then allowed to dwell for about 15 minutes providing stability to the zirconium salt component of the NUXTRA compound. Separately, one mixes 3.5 volume percent of xylene, 7.5 volume percent of 2-ethylhexanoic acid, 7.4 volume percent of the dimethyl ether of propylene glycol, and 51.8 volume percent of dioctyl phthalate. The two separately mixed batches are then mixed together and stirred to form a fuel additive in accordance with this invention.

The above formulation may be added to gasoline in the previously indicated ranges to provide enhanced combustion characteristics.

EXAMPLE 3

A formulation is compounded as shown in Example 2, but in place of the xylene, one uses the same amount of toluene, and in place of the dioctyl phthalate, one uses the same amount of petroleum lubricant distillate sold under the trademark CORAY 15, by Exxon Corporation. The distillate is from an asphaltic crude, boiling between 300° and 400° C. and containing between 30 and 40 percent aromatic molecules.

EXAMPLE 4

A formulation is compounded as shown in Example 2, but in place of xylene, one uses the same amount of a high flash naphtha, and in place of the dioctyl phthalate, one uses the same amount of sesame seed oil, to obtain an advantageous gasoline additive.

EXAMPLE 5

A formulation can be compounded as shown in Example 1, but in place of the dioctyl phthalate, one uses the same amount of Exxon's CORAY 15.

I claim:

1. An engine fuel composition comprising gasoline and from 0.01 to about 0.1 percent by weight of a composition comprising, in solution:
   - about 10 to about 35 percent by volume of a zirconium salt of an organic acid;
   - about 10 to 35 percent by volume of a plasticizer boiling above 300° C. and comprising as a part of its structure an acid derived ester group or an aromatic group, or both;
   - from 0 to about 6 percent by volume of an organic acid capable of forming a salt with zirconium; and
   - a solvent for said zirconium salt and said plasticizer, comprising a hydrocarbon or a halogenated aliphatic hydrocarbon, or a mixture thereof, as a major component.

2. The engine fuel composition of claim 1 in which said organic acid is a mixture of branched-chain acids of 9–12 carbon atoms.

3. The engine fuel of claim 1 in which said organic acid is 2-ethylhexanoic acid.

4. The engine fuel composition of claim 1 in which said plasticizer is a naturally occurring glycerol ester of a major amount of fatty acid selected from oleic acid and linoleic acid, or both, and a minor amount of palmitic acid.

5. The engine fuel composition of claim 1 in which said plasticizer is a dialkyl phthalate.

6. The engine fuel composition of claim 5 in which said plasticizer is dioctyl phthalate.

7. The engine fuel composition of claim 1 in which said plasticizer is a petroleum lubricant distillate from an asphaltic crude, boiling between 300°–400° C. and containing between 30 and 40 percent aromatic molecules.

8. The engine fuel composition of any of claims 1, 2, 3, 4, 5, 6 or 7 in which the concentration of the zirconium salt is 16–22 percent by volume, the concentration of the plasticizer is 22–26 percent by volume and the concentration of the acid is 0–4 percent by volume.

9. The engine fuel composition of claim 8 in which the concentration of said composition in said gasoline is from about 0.02 to 0.06 percent by volume.

* * * * *